United States Patent [19]

Hartness et al.

[11] 4,169,342

[45] Oct. 2, 1979

[54] ARTICLE SEPARATING DEVICE FOR CASE LOADING MACHINE

[76] Inventors: Thomas P. Hartness, 305 Bridgewater Dr.; Robert G. Hartness, 203 Wilmington Rd., both of Greenville, S.C. 29601

[21] Appl. No.: 851,603

[22] Filed: Nov. 14, 1977

[51] Int. Cl.[2] ..... B65B 39/02; B65B 21/06

[52] U.S. Cl. ..... 53/248; 53/497; 198/491

[58] Field of Search ..... 53/61, 62, 166, 247, 53/248; 198/424, 425, 491

[56] References Cited

U.S. PATENT DOCUMENTS

| | | | |
|---|---|---|---|
| 3,125,205 | 3/1964 | Kinney | 53/61 X |
| 3,431,702 | 3/1969 | Spaulding | 53/166 X |
| 3,479,791 | 11/1969 | Wild | 53/61 |
| 4,048,783 | 9/1977 | Raudat et al. | 53/61 |

*Primary Examiner*—Travis S. McGehee

*Attorney, Agent, or Firm*—Bailey, Dority & Flint

[57] ABSTRACT

An apparatus for controlling the flow of articles being fed to a case packer in rows on a transporting surface by separating a predetermined number or charge of articles loaded on the case packer from the incoming articles. The apparatus includes a plurality of divider plates which separate the articles into rows and a plurality of fluid operated cylinders which are carried above the rows. The cylinders have pistons extending downwardly therefrom upon which an elongated abutment is carried. These cylinders are selectively activated for raising and lowering the abutments into and out of the path of the incoming articles for stopping the flow of articles to the case packer. This is to enable the articles to be loaded into a case without being adversely affected by the pressure of the incoming articles bearing thereagainst. The cylinders are carried on a plate whose longitudinal position can be adjusted for loading articles of different sizes.

3 Claims, 5 Drawing Figures

ARTICLE SEPARATING DEVICE FOR CASE LOADING MACHINE

BACKGROUND OF THE INVENTION

The present invention relates to an apparatus for controlling the flow of articles to a case packing machine and, more particularly, to an apparatus which stops the forward movement of articles onto a case loading machine when a charge of articles are being loaded into a case.

Case packing machines such as utilized for depositing articles into cartons or cases are well known, and one such case packing machine is disclosed in U.S. Pat. No. 3,788,034. In the article loading machine disclosed in that patent, twenty-four bottles are deposited into the cases simultaneously. These bottles are lowered through a grid set into the case. The bottles are fed to the case packer on a continuously moving conveyor, therefore, it is necessary to restrain the bottles to prevent them from being delivered from the conveyor to the case packing machine when the bottles are being loaded into the case. As illustrated, this is accomplished by means of a presser plate which bears down on the top of the seventh and eighth bottles in each of the rows so as to prevent them from being pushed into the case packer. After the first six bottles of each row have been deposited into the case by laterally shifting the bottle supporting member, the bottle supporting member is shifted laterally back to its bottle supporting position. The presser plate is raised off of the bottles and an additional charge of bottles are permitted to be loaded onto the case packer.

In another device such as disclosed in U.S. Pat. No. 3,325,967, additional bottles are prevented from being fed to the case packer by stop pins which are shifted laterally when the bottles are being loaded into the case packer. One problem with utilizing the laterally shifting pins for preventing the flow of bottles to the case packer is that if a bottle is out of alignment, the pin will strike the bottle preventing the supporting bars which permit the bottles to be dropped into the case from being shifted laterally. Another problem incurred by using a pin or stop which is shifted laterally into the path of bottles is that the diameter or thickness of the vertically extending stop is limited to the thickness of the guide plates so as to permit the bottles to pass between the guide plates when the stops are retracted. As a result, the pins or stops tend to break off, bend or wear out.

Examples of other article or bottle spreading devices utilized in conjunction with case packers are disclosed in U.S. Pat. Nos. 2,350,560; 2,755,611; and 2,898,715. All of these patents include mechanisms which raise abutments into the path of the incoming articles so as to prevent their forward movement while a charge of articles are being deposited into a case.

One problem with the bottle separating devices heretofore utilized is that there was no ready means of adjusting the location that the abutment is brought into the path of incoming bottles for accommodating different size bottles.

SUMMARY OF THE INVENTION

The invention pertains to an apparatus for controlling the flow of articles being fed to a case packer in rows on a transporting surface of a conveyor. The case packer has an article supporting member which is shifted laterally for depositing a charge of articles into a case. A plurality of vertically extending divider plates are carried between the rows of the articles for maintaining the articles in the prescribed rows as the articles are fed onto the case packer. Vertically extending abutments are carried above the divider plates and the path of travel of the articles as the articles are transported to the case packer. Means is provided for selectively lowering the vertically extending abutments into the path of travel of the articles for separating a predetermined number of articles loaded on the case packer from the articles being fed to the case packer from the transporting surface. The longitudinal position of the abutments can be adjusted so that the apparatus can accommodate bottles or articles of different diameters.

The abutments include elongated members having a substantially square cross-section. These elongated members have guide slots provided adjacent corners thereof in which the ends of separated divider plates ride for guiding the upward and downward movement of the abutments. The abutments when looking down from the top are positioned so that the square cross-sectional shape presents a diamond configuration to the incoming bottles. This provides a maximum surface contact between the sides of the bottles or articles when the abutment is in the restraining position.

Accordingly, it is an important object of the present invention to provide an apparatus for controlling the flow of articles such as bottles to a case packing machine.

Another important object of the present invention is to provide an apparatus for restraining the inflow of articles to a case packing machine while a charge of said articles is being deposited into a case.

Still another important object of the present invention is to provide a simple and efficient mechanism which can be readily adjusted for separating bottles of different sizes so that they can be loaded into cases.

Still another important object of the present invention is to provide an apparatus which can be readily synchronized with the operation of a case packing machine to ensure that bottles or articles are not loaded into the case packing machine until the case packer is in a position to receive them.

These and other objects and advantages of the invention will become apparent upon reference to the following specification, attendant claims, and drawings.

DESCRIPTION OF THE PREFERRED EMBODIMENT

Figure 1:
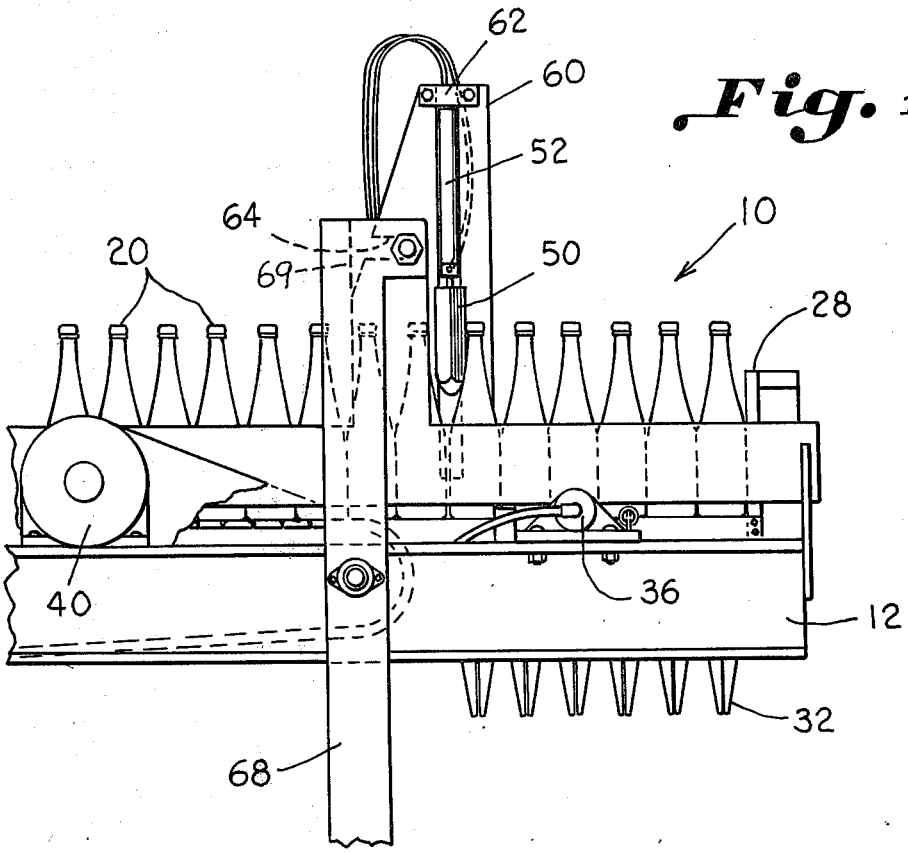
FIG. 1 is a side elevational view illustrating an apparatus constructed in accordance with the present invention for restraining the inflow of bottles into a case loading machine.

Referring in more detail to the drawings, there is illustrated a portion of a case packer generally designated by the reference character 10 such as illustrated in more detail in U.S. Pat. No. 3,788,034. The case packer includes a frame composed of a pair of spaced side rails 12 that are joined by a end member 14. Divider plates 16 extend from the end member 14 back over a conveyor 18 for maintaining articles such as bottles 20 in rows. These bottles as they are fed into the case packer are supported on laterally spaced bars 22 which form part of an article supporting frame. The article supporting frame includes side walls 24 and 26 which are joined by end walls 28 and 30 to form a substantially rectangular shaped frame.

Figure 2:
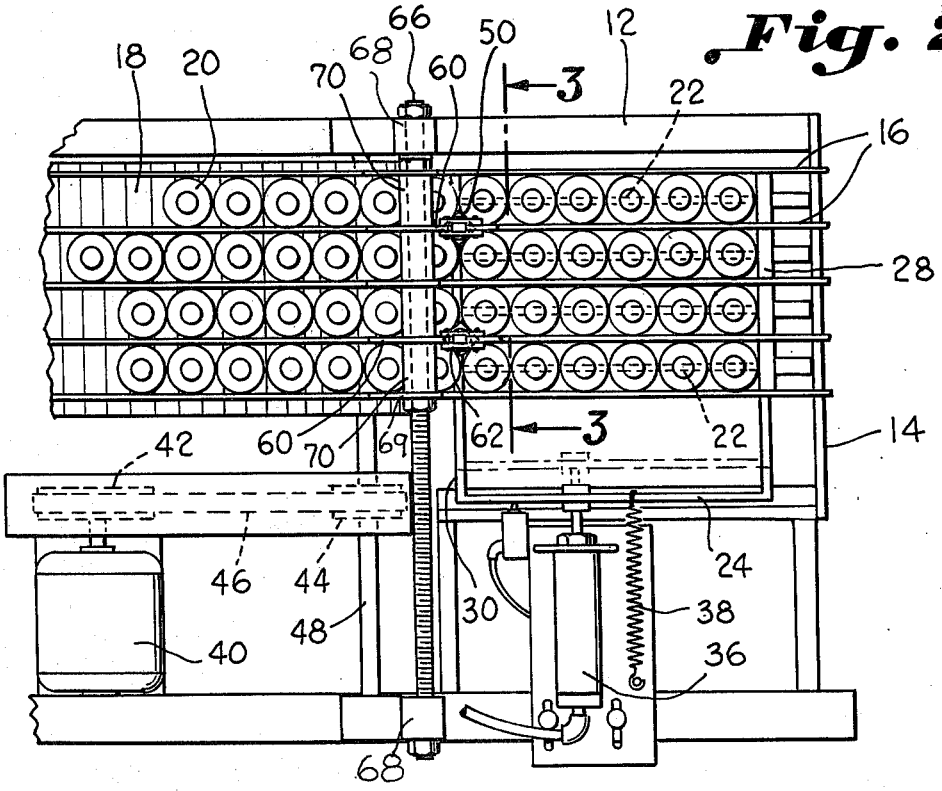
FIG. 2 is a plan view of the apparatus illustrated in FIG. 1.
Figure 3:
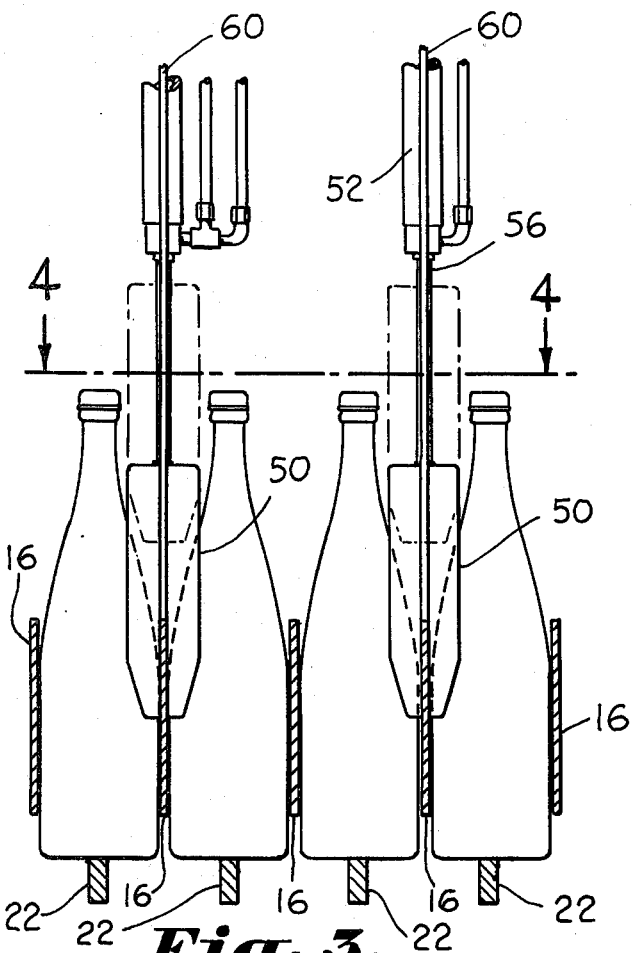
FIG. 3 is a sectional view taken along line 3—3 of FIG. 2.

As a charge of bottles such as illustrated by the twenty-four bottles shown on the right in FIG. 2 are positioned over a grid set which inclues positioning fingers 32, they activate a conventional switching mechanism 34 (see FIG. 5) which, in turn, causes air to be supplied to a cylinder 36. When air is applied in the end of the cylinder 36, it shifts the frame, dropping the bottles 20 through the fingers 32 into a case carried therebelow. After the bottles have been deposited, a spring 38 retracts the frame to the full line position as illustrated in FIG. 2.

The conveyor 18 is driven by an electric motor 40 by means of pulleys 42 and 44 and a belt 46. The pulley 44 is fixed to a shaft 48 which is coupled to the conveyor 18. In normal operation, the conveyor 18 is running continuously, and as a result, the bottles 20 are continuously fed to the right and loaded onto the case packer. It is necessary that the charge of bottles 20 that are loaded in the case packer be separated from the incoming bottles so as to permit the bottles to drop freely through the grid fingers 32 when being loaded into a case. The incoming bottles must be held back until the shifting frame is returned to its initial position after dropping the bottles into the case.

In order to separate the bottles so that the charge of bottles on the right can drop through the grid fingers 32, vertically extending abutments 50 are carried above the divider plate 16 and over the path of travel of the bottles as they are fed onto the case packer. Fluid operated cylinders 52 are provided for raising and lowering the abutments 50 into and out of the path of the incoming bottles. The cylinder 52 is a double-acting cylinder which has a piston 54 provided therein. Extending downwardly from the piston 54 is a piston rod 56 upon which the abutment 50 is attached. The abutment 50 may be constructed of any suitable material such as nylon and has a substantially square shaped configuration.

Figure 4:
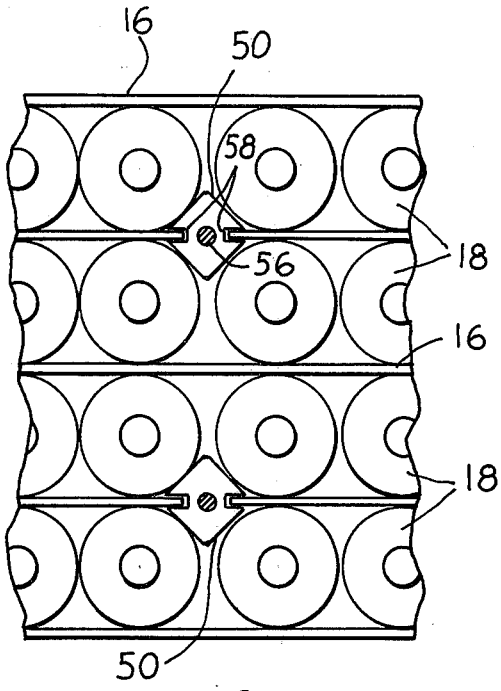
FIG. 4 is an enlarged plan view taken along line 4—4 of FIG. 3.

The elongated abutment 50 has a substantially square shaped cross section and has elongated vertically extending slots 58 provided in a pair of opposed corners thereof. Two of the vertically extending divider plates 16 are split so that the ends of the split divider plates 16 ride in the slots 58 for aiding and guiding the upward and downward movement of the abutments 50. As seen in FIG. 4, the abutments 50 are positioned so that two opposed corners are positioned a maximum distance laterally from the divider 16. In other words, the square shaped abutments present a diamond configuration to the incoming bottles 20 so as to provide maximum surface contact between the sides of the bottles 20 and the sides of the abutment 50.

The cylinder 52 is supported within a vertically extending slot provided in a raised plate 60. A clamp 62 which includes bolts and nuts is attached to the cylinder and to the top of the plate 60 for securing such together. The plate 60 also has a laterally extending groove 64 provided therein. The purpose of this groove is to allow the position of the plate and, consequently, the cylinder and abutment 50 to be moved longitudinally in the direction of the flow of the bottles so as to accommodate bottles of different sizes. A threaded bolt 66 extends through the slot 64 of the vertically extending member 60 and is supported on opposite ends by upwardly extending braces 68 such as best illustrated in FIGS. 1 and 2. Each of the divider plates 16 has a vertically extending portion 69 through which the bolt 66 extends for securing and maintaining the divider plates 16 in position. Spacers 70 are carried between the adjacent divider plates 16 on the bolt 66 for maintaining the proper spacing between the divider plates. The divider plates 60 have the slots 64 provided therein so they can be adjusted longitudinally. It is only necessary that the second and fourth divider plates looking at FIG. 2 be adjustable, since when the abutment is lowered it stops the flow of articles in the rows provided adjacent thereto.

Figure 5:
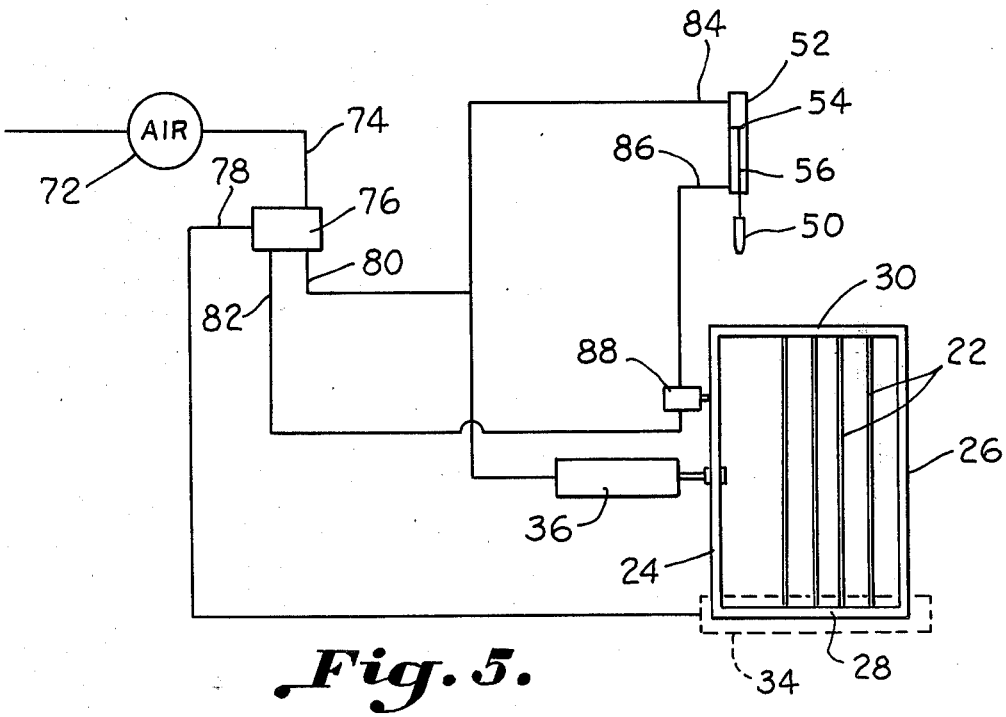
FIG. 5 is a schematic air and electrical flow diagram for controlling the operation of the article restraining mechanism.

Referring to FIG. 5, there is illustrated a source of pressurized air 72 which has a line 74 connected therefrom to a time delay switch 76. The switch 76 is an electrically operated switch that responsive to receiving an electrical signal on input lead 78 connects the source of air between the input pipe 74 and one or the other output pipes 80 or 82. The output pipe 80 is, in turn, connected to the top port 84 of the cylinder 52. It is also connected to the end of the cylinder 36 which is used for moving the frame laterally when depositing the bottles into the case.

Connected between a lower port 86 of the cylinder 52 and the output port 82 of the switch 76 is a pneumatic switch 88 which must be opened prior to air being supplied to the lower port 86 of the cylinder 52 for raising the abutment 50. This prevents the abutment 50 from being raised if any of the bottles have not dropped completely through the grid thus preventing the frame from being retracted.

A switch mechanism 34 is carried adjacent to the end of the case loading machine and is closed responsive to the bottles being pushed completely to the end of the case packer and a complete charge of bottles being placed thereon. This is a conventional switch and may take many different forms. When the switch 34 is closed, a signal is sent to the switch 76 activating the switch causing air to be supplied to the top port 84 of cylinder 52 as well as to the cylinder 36. When air is supplied to the top port of cylinder 52, it causes the piston to be shifted downwardly lowering the abutment 50 into the path of the incoming bottles separating the bottles. The air coming into the rear of the cylinder 36, in turn, pushes the frame from the full line position as illustrated in FIG. 2 to the dotted line position allowing the bottles to be dropped into the case carried therebelow. Normally, the flow of air into the cylinder is dampened slightly as compared to the flow being supplied to the top port 84 of the cylinder 52 so as to ensure that the abutments have been lowered prior to the bottles being dropped through the case packer.

After a predetermined period of time controlled by an electrical time delay in switch 76, the switch then supplies air through output tube 82 and removes the pressure from output tube 80. The spring 38 returns the frame to the left until it contacts mechanical air valve 88 which allows air to be supplied to the bottom port of cylinder 52. This, in turn, causes the abutment to be raised to allow another charge of bottles to be fed into the case packer.

While a preferred embodiment of the invention has been described using specific terms, such description is for illustrative purposes only, and it is to be understood that changes and variations may be made without departing from the spirit or scope of the following claims.

What is claimed is:

1. An apparatus for controlling the flow of articles being fed to a case packer in rows on a transporting surface of a conveyor, said case packer having an article supporting member which is shifted for depositing a predetermined number of articles into a case, said apparatus comprising:

a plurality of vertically extending divider plates carried between said rows of articles maintaining said articles in rows as said articles are fed onto said case packer, vertically extending abutments carried above said divider plates and the path of travel of said articles as said articles are transported to said case packer, means for selectively lowering said vertically extending abutments into the path of travel of said articles for separating a predetermined number of said articles loaded on said case packer from said articles being fed to said case packer on said transporting surface, means for adjusting the longitudinal position of said abutments along said path of said articles so that articles of different diameters can be separated, and each of said abutments includes, an elongated vertically extending member;

at least alternate divider plates being separated directly below said elongated vertically extending members so that said elongated vertically extending members are raised and lowered in said separations, and a vertically extending guide slot provided in said elongated vertically extending member into which an end of said separated divider plate extends for guiding said vertically extending member as it is raised and lowered.

2. The apparatus as set forth in claim 1 further comprising:

said elongated vertically extending member having a substantially square cross-section, said vertically extending guide slot being provided in at least one corner of said vertically extending member, and the adjacent corners of said vertically extending member being positioned the maximum distance on opposite sides of a divider plate.

3. An apparatus for controlling the flow of articles of a cylindrical cross section being fed to a case packer in rows on a transporting surface of a conveyor, said case packer having an article supporting member which is shifted for depositing a predetermined number of articles into a case, said apparatus comprising:

a plurality of vertically extending divider plates carried between said rows of articles maintaining said articles in rows as said articles are fed onto said case packer, vertically extending abutments carried above said divider plates and the path of travel of said articles as said articles are transported to said case packer, said abutments having a square cross section and being carried to present a diamond configuration to said incoming articles so as to provide maximum surface contact between the sides of articles of adjacent rows, and means for selectively lowering said vertically extending abutments into the path of travel of said articles for separating a predetermined number of said articles loaded on said case packer from said articles being fed to said case packer on said transporting surface.

* * * * *